US009744740B2

(12) United States Patent
Abe

(10) Patent No.: US 9,744,740 B2
(45) Date of Patent: Aug. 29, 2017

(54) SHEET PROCESSING APPARATUS AND IMAGE FORMING APPARATUS

(71) Applicant: CANON KABUSHIKI KAISHA, Tokyo (JP)

(72) Inventor: Hideto Abe, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 162 days.

(21) Appl. No.: 14/427,184

(22) PCT Filed: Oct. 31, 2013

(86) PCT No.: PCT/JP2013/006459
§ 371 (c)(1),
(2) Date: Mar. 10, 2015

(87) PCT Pub. No.: WO2014/068985
PCT Pub. Date: May 8, 2014

(65) Prior Publication Data
US 2015/0239587 A1 Aug. 27, 2015

(30) Foreign Application Priority Data
Nov. 2, 2012 (JP) ..... 2012-242699

(51) Int. Cl.
*B31F 5/02* (2006.01)
*B31F 1/07* (2006.01)
(Continued)

(52) U.S. Cl.
CPC ..... *B31F 5/02* (2013.01); *B31F 1/07* (2013.01); *B42B 5/00* (2013.01); *B65H 33/00* (2013.01);
(Continued)

(58) Field of Classification Search
CPC ..... G03G 15/6544; G03G 2215/00852; B31F 1/07; B31F 5/02; B31F 2201/0712;
(Continued)

(56) References Cited

U.S. PATENT DOCUMENTS 3,727,908 A * 4/1973 Whitesell ..... A01B 33/06 156/290
8,845,258 B2 9/2014 Mori
(Continued)

FOREIGN PATENT DOCUMENTS

JP 2010-189101 A 9/2010
JP 2010-208854 A 9/2010
(Continued)

OTHER PUBLICATIONS

U.S. Appl. No. 14/727,039, filed Jun. 1, 2015.
U.S. Appl. No. 14/729,587, filed Jun. 3, 2015.

*Primary Examiner* — Leslie A Nicholson, III
(74) *Attorney, Agent, or Firm* — Fitzpatrick, Cella, Harper & Scinto

(57) ABSTRACT

A staple-less binding unit is provided with upper and lower die portions having pluralities of concave and convex teeth engaging with each other. A control portion causes the staple-less binding unit to carry out a binding process of binding a sheet bundle by biting the sheet bundle by the upper and lower die portions and to carry out a cleaning process of engaging the upper and lower die portions in a non-binding process in which no binding process is carried out.

21 Claims, 15 Drawing Sheets

(51) Int. Cl.

| | |
|---|---|
| ***G03G 15/00*** | (2006.01) |
| ***B42B 5/00*** | (2006.01) |
| ***B65H 37/04*** | (2006.01) |
| ***B65H 33/00*** | (2006.01) |
| ***B65H 43/00*** | (2006.01) |

(52) U.S. Cl.
CPC ..... *B65H 37/04* (2013.01); *B65H 43/00* (2013.01); *G03G 15/00* (2013.01); *G03G 15/6541* (2013.01); *G03G 15/6544* (2013.01); *B31F 2201/0712* (2013.01); *B31F 2201/0771* (2013.01); *B65H 2301/43828* (2013.01); *B65H 2301/51616* (2013.01); *B65H 2801/27* (2013.01); *G03G 2215/00852* (2013.01)

(58) Field of Classification Search
CPC . B31F 2201/0771; B65H 37/04; B65H 43/00; B65H 33/00; B65H 2301/51616; B65H 2301/43828
USPC ..... 270/58.07, 58.08, 58.09; 493/390
See application file for complete search history.

(56) References Cited

U.S. PATENT DOCUMENTS

| | | | | |
|---|---|---|---|---|
| 9,090,051 | B2 * | 7/2015 | Takahashi | B31F 5/02 |
| 9,254,621 | B2 * | 2/2016 | Takahashi | B42C 13/00 |
| 9,409,740 | B2 * | 8/2016 | Kubo | G03G 15/6541 |
| 9,415,560 | B2 * | 8/2016 | Morinaga | B42C 13/00 |
| 9,440,478 | B2 * | 9/2016 | Takahashi | B42B 5/00 |
| 2010/0202814 | A1 | 8/2010 | Nakamura | |
| 2014/0003852 | A1 | 1/2014 | Abe et al. | |
| 2014/0077437 | A1 | 3/2014 | Abe et al. | |
| 2014/0161565 | A1 | 6/2014 | Obuchi et al. | |
| 2014/0353900 | A1 * | 12/2014 | Abe | B42B 5/00 270/58.08 |
| 2015/0003939 | A1 | 1/2015 | Abe | |

FOREIGN PATENT DOCUMENTS

| | | | | |
|---|---|---|---|---|
| JP | 2011-201698 | A | | 10/2011 |
| JP | 2014156349 | A | * | 8/2014 |
| WO | 2011-018897 | A1 | | 2/2011 |

* cited by examiner

SHEET PROCESSING APPARATUS AND IMAGE FORMING APPARATUS

TECHNICAL FIELD

The present invention relates to a sheet processing apparatus including a binding portion configured to bind a bundle of sheets, and to an image forming apparatus.

BACKGROUND ART

Hitherto, some image forming apparatuses such as a copier, a laser beam printer, a facsimile machine, and a multi-function printer are provided with a sheet processing apparatus configured to carry out such a process as stapling on sheets on which images have been formed. Such a sheet processing apparatus is configured to bind a sheet bundle by using a metallic staple. Such a stapling process using the staple is adopted in many sheet processing apparatuses because it enables to bind a plurality of output sheets reliably at a position specified by a user.

However, it is necessary, and hence troublesome, to remove the staple in putting the stapled sheets through a shredder. It is also necessary and troublesome to remove the staple to separate the sheets and the staple in recycling the stapled sheet bundle from an aspect of environmental concerns.

Due to that, Japanese Patent Application Laid-open No. 2010-189101 proposes a sheet binding apparatus provided with a pair of die members having concave and convex teeth. This sheet binding apparatus binds a sheet bundle by entangling fibers of the overlapping sheets with each other by forming concave and convex portions on the sheet bundle in a thickness direction thereof by engaging the pair of die members after stacking and aligning the sheets. That is, this sheet binding apparatus binds the fibrous sheets without using staples.

However, such a sheet binding apparatus is liable to cause such a problem that the sheet is torn and paper powder thereof attaches on the teeth of the die members if the sheet bundle on the way of the binding process is forcibly pulled and taken out due to such a reason of jamming of a sheet.

Still further, if a number of times of the binding process increases, the paper powder generated during a fastening process may accumulate between the teeth of the pair of die members. If the paper powder attaches on the teeth or accumulates between the teeth as described above, there is a possibility that the paper powder affects the engagement of the upper and lower dies in executing a next binding process and drops a fastening power of the sheet bundle that has been bound.

SUMMARY OF INVENTION

A sheet processing apparatus of the present invention includes a sheet stacking portion configured to stack a plurality of sheets, a binding portion having first and second die portions disposed so as to face with each other and having a plurality of concave and convex teeth that engage with each other, the binding portion binding a sheet bundle formed on the sheet stacking portion by biting the sheet bundle by the first and second die portions, and a control portion controlling the binding portion to carry out a binding process of binding the sheet bundle by biting the sheet bundle by the first and second die portions and to carry out a cleaning process of engaging the first and second die portions in a non-binding process in which no binding process is carried out.

It is possible to remove dusts of the sheet attaching to the teeth of the die portions and to prevent a drop of fastening power in a binding process by causing the binding portion to carry out the cleaning process of engaging the first and second die portions in the non-binding process.

Further features of the present invention will become apparent from the following description of exemplary embodiments with reference to the attached drawings.

DESCRIPTION OF EMBODIMENTS

Figure 1:
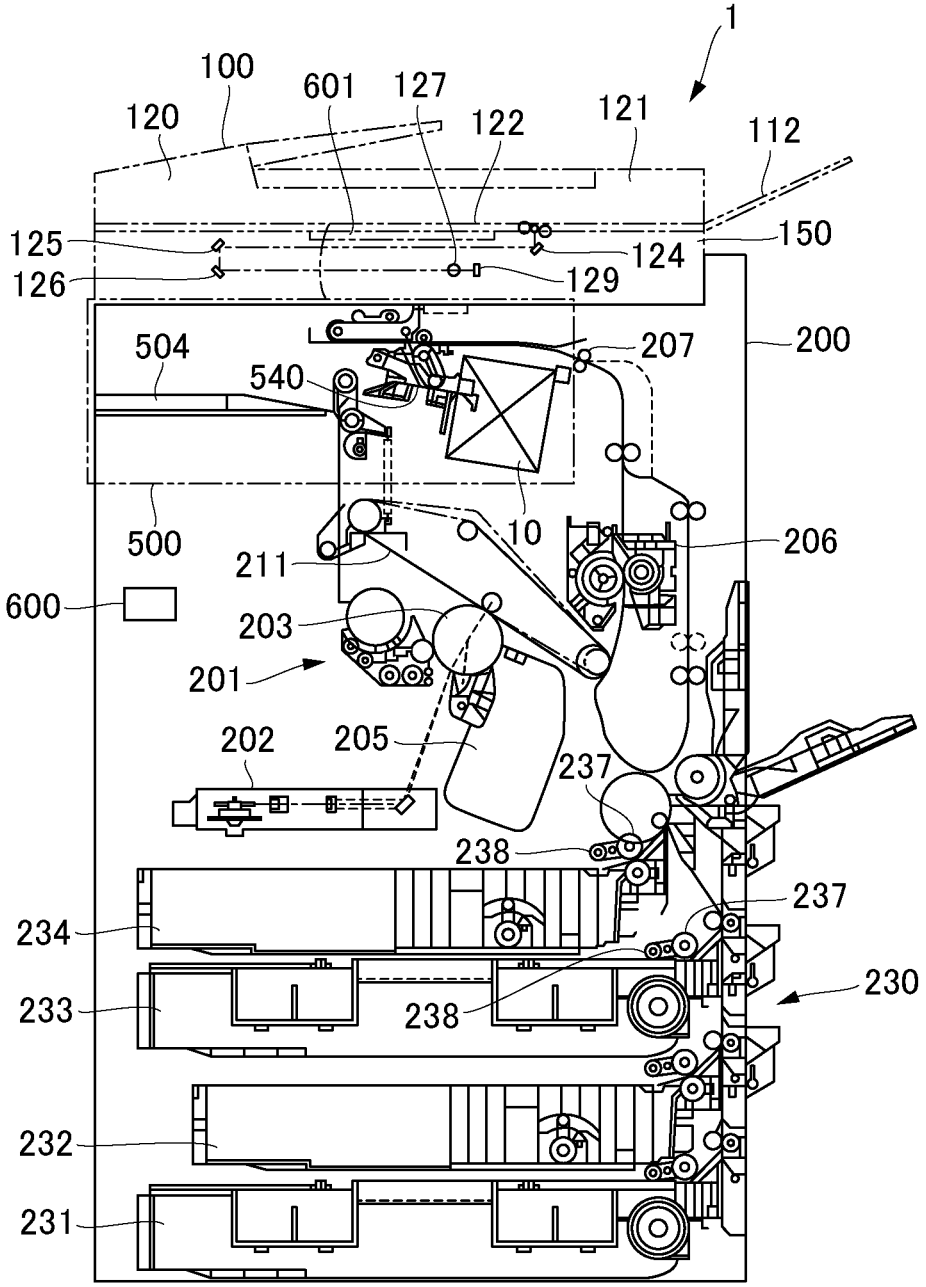
FIG. 1 is a diagram illustrating a configuration of an image forming apparatus provided with a sheet processing apparatus of an embodiment of the invention.

An embodiment for carrying out the present invention will be described below in detail with reference to the drawings. FIG. 1 is a diagram illustrating a configuration of an image forming apparatus provided with a sheet processing apparatus of the embodiment of the invention. As shown in FIG. 1, the image forming apparatus 1 includes a body of the image forming apparatus (referred to as an "apparatus body" hereinafter) 200 and an image reading apparatus 100 provided on an upper part of the apparatus body 200. The image reading apparatus 100 includes a document feeding apparatus 121 configured to automatically feed a document and a document reading portion 150 configured to read an image of the document fed by the document feeding apparatus 121. The document feeding apparatus 121 includes a document feeding portion 120 configured to feed the document and a discharge tray 112 to which the document is discharged. The document reading portion 150 includes a platen glass 122 on which the document is placed, a scanner unit 124 configured to read the image of the document, a lens 127, and an image sensor 129.

The apparatus body 200 includes an image forming portion 201 configured to form an image and a feed portion 230 configured to feed a sheet to the image forming portion 201. The image forming portion 201 includes a photoconductive drum 203, an exposure portion 202 configured to form an electrostatic latent image on the photoconductive drum 203, and a developer 205 configured to visualize the electrostatic latent image formed on the photoconductive drum 203. The feed portion 230 includes cassettes 231 through 234 in which sheets are stored, a pickup roller 238 configured to feed the sheets stored in the cassettes 231 through 234, and a separating portion 237 configured to separate the sheets to be fed one by one.

The image forming apparatus 1 is also provided with a finisher 500, i.e., a sheet processing apparatus, between an upper surface of the apparatus body 200 and the image reading apparatus 100, and with a control portion 600 configured to control the finisher 500 and the apparatus body 200.

Next, an image forming operation of the image forming apparatus 1 configured as described above will be described. Documents set in the document feeding portion 120 are fed one by one in order from a top page and conveyed on the platen glass 122. The image reading apparatus 100 reads an image of the document conveyed on the platen glass 122 by irradiating the document by a lamp of the scanner unit 124 and by leading light reflected from the document to the image sensor 129 through first and second minors 125 and 126 and the lens 127. The document from which its image has been read is discharged to the discharge tray 112.

The image of the document read by the image sensor 129 undergoes image processing and is sent to the exposure portion 202 which irradiates a laser beam to the photoconductive drum 203 whose surface is homogeneously charged. The laser beam is reflected by a rotating polygon minor and is turned back further by a reflection minor to be irradiated to the photoconductive drum 203 to form an electrostatic latent image on the photoconductive drum 203. This electrostatic latent image is then developed by the developer 205 as a toner image and the toner image is transferred to a transfer belt 211.

Concurrently with this image forming operation, the sheet stored in the cassettes 231 through 234 is selectively sent out by the pickup roller 238, is separated one by one by the separating portion 237, and is sent to a transfer position in synchronism with rotation of the photoconductive drum 203. Then, the toner image that has been transferred to the transfer belt 211 is transferred to the sheet in the transfer position. After that, the sheet on which the toner image has been transferred is conveyed to a fixing roller pair 206 and undergoes heating and pressing processes performed by the fixing roller pair 206 to fix the toner image on the sheet. The sheet on which the toner image has been fixed is led to the finisher 500 by a discharge roller pair 207.

Figure 2:
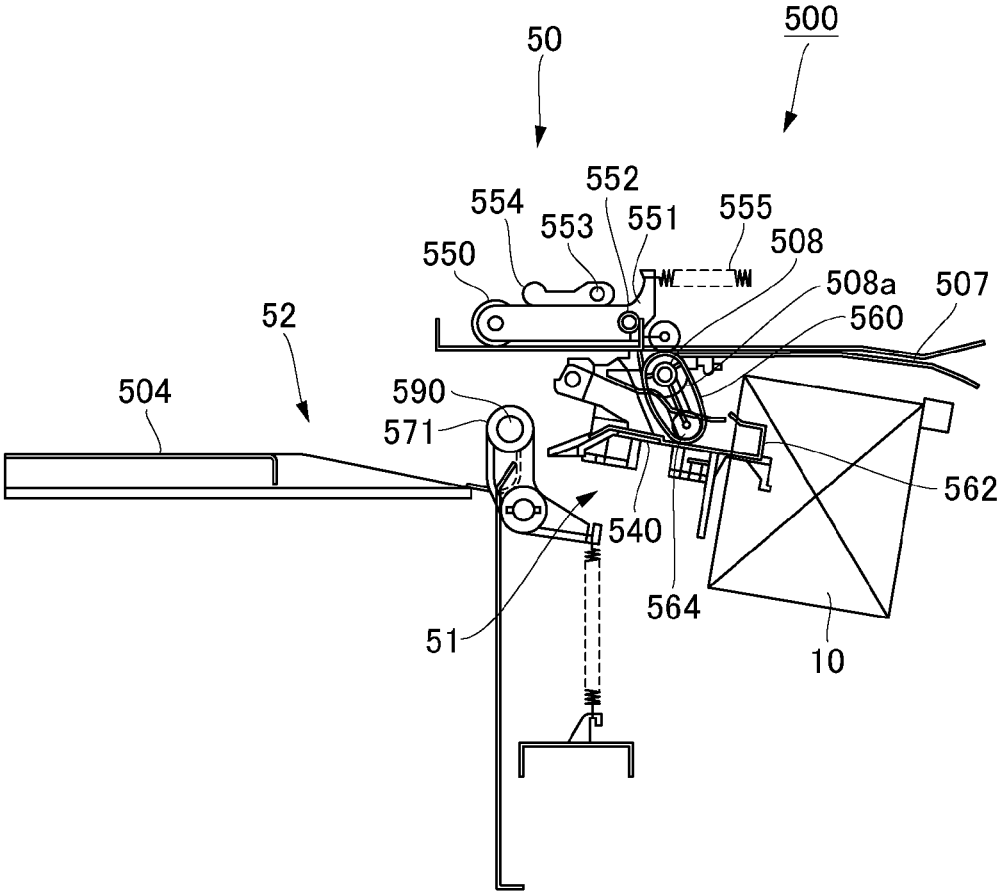
FIG. 2 illustrates a configuration of a finisher, i.e., the sheet processing apparatus.

As shown in FIG. 2, the finisher 500 is provided with a discharge roller 508, a swing and guide portion 50 configured to swing and guide the sheet conveyed by the discharge roller 508, and a sheet processing portion 51 configured to process the sheet. The finisher 500 is also provided with a sheet bundle stacking portion 52 configured to stack an aligned bundle of sheets.

The discharge roller 508 is provided along a conveying path 507 connected with the apparatus body 200, and conveys the sheet lead by the discharge roller pair 207 of the apparatus body 200 into the finisher 500. The discharge roller 508 is driven by a conveyance motor M750 shown in FIG. 8 and described later. The drive of the conveyance motor M750 is controlled based on detection of a sheet detected by a sheet position detecting sensor S770 shown in FIG. 8 and described later and provided along the conveying path 507.

The swing and guide portion 50 is provided with a swing arm 551, a swing cam 554 and a swing roller 550 rotatably disposed at one end of the swing arm 551. The swing arm 551 is disposed downstream in a sheet conveying direction of the discharge roller 508 and above the conveying path 507 and is supported swingably in an up-and-down direction centering on a swing shaft 552. A tensile spring 555 that biases the swing arm 551 clockwise is attached at another end of the swing arm 551.

The swing cam 554 is provided above the swing arm 551 and is supported rotatably in the up-and-down direction centering on the cam shaft 553. The swing cam 554 rotates downward when the cam shaft 553 is rotated by a swing arm driving motor M751 shown in FIG. 8 and described later. When the swing cam 554 thus rotates downward, the swing arm 551 provided under the swing cam 554 is pressed and swings counterclockwise by resisting against the tensile spring 555.

The swing roller 550 rotatably supported at one end of the swing arm 551 is rotated by a swing roller driving motor M752 shown in FIG. 8 and described later through a driving belt and a driven pulley not shown. The swing roller 550 moves to a home position thereof above the conveying path 507 where the swing roller 550 does not contact with the sheet discharged by the discharge roller 508 until when the sheet comes to be conveyed. It is noted that the movement of the swing roller 550 to the home position is controlled based on a signal from a swing arm home sensor S771 shown in FIG. 8 and described later.

Figure 3:
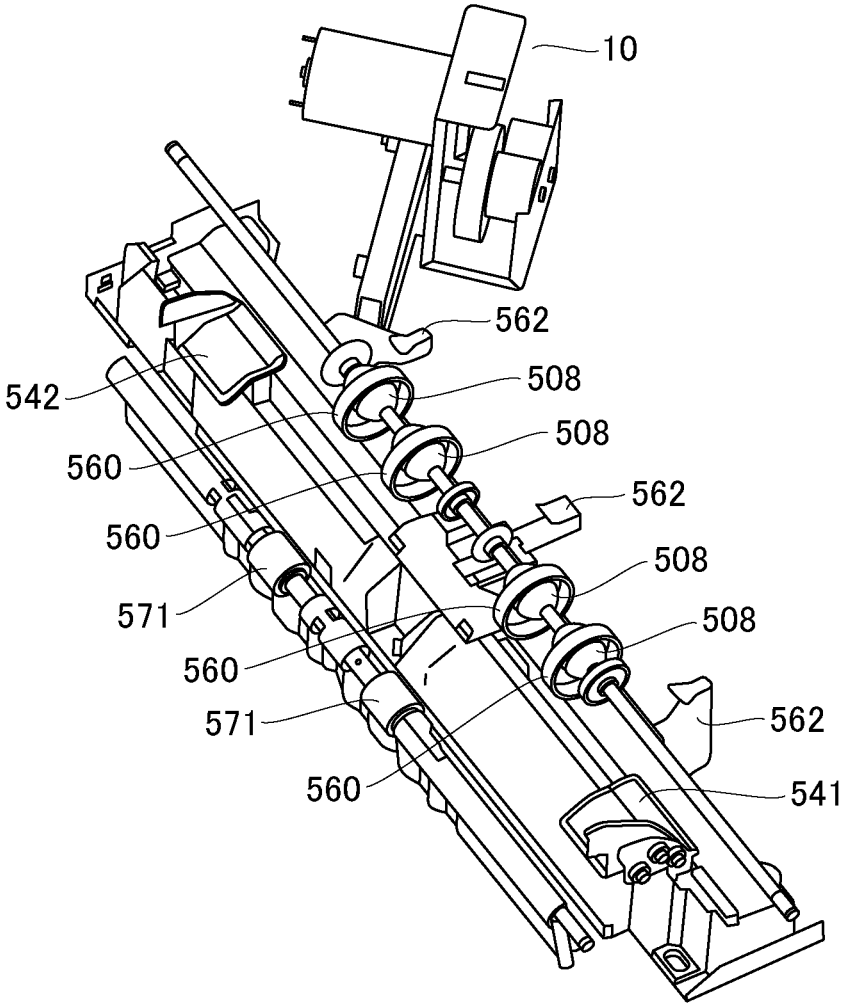
FIG. 3 illustrates an aligning portion provided in the finisher.

The sheet processing portion 51 is provided with an intermediate processing tray 540 serving as a sheet stacking portion, a return belt 560, a rear end stopper 562, front and rear aligning plates 541 and 542 serving as a pair of aligning members shown in FIG. 3, and a staple-less binding unit 10. The intermediate processing tray 540 is provided under the discharge roller 508 and temporarily stacks sheets discharged from the discharge roller 508 and to be processed.

The return belt 560 is suspended around a pulley **508*a* provided around a rotary shaft of the discharge roller 508 and a driven pulley 564 and conveys the sheet discharged to the intermediate processing tray 540 to an upstream in the sheet conveying direction by rotating while being in contact with the sheet stacked on the intermediate processing tray 540. It is noted that the return belt 560 is configured so as to recede in a sheet thickness direction corresponding to a number of sheets stacked on the intermediate processing tray 540. The rear end stopper 562 is disposed at an upstream end in the sheet conveying direction of the intermediate processing tray 540 and aligns a position of the sheets in the sheet conveying direction by abutting against an upstream end in the sheet conveying direction of the sheets conveyed upstream in the sheet conveying direction by the return belt 560**.

The front and rear aligning plates 541 and 542 are constructed to be movable in a width direction intersecting with the sheet conveying direction on the intermediate processing tray 540, and align a widthwise position of the sheets by pressing widthwise both ends of the sheets in moving in the width direction. It is noted that the front aligning plate 541 is driven by a front aligning plate motor M753 shown in FIG. 8 and described later and the rear aligning plate 542 is driven by a rear aligning plate motor M754 shown in FIG. 8 and described later.

Home positions of the front and rear aligning plates 541 and 542 are set at positions where they do not contact with the sheet when the sheet is conveyed to the intermediate processing tray 540. These home positions are also positions where the front and rear aligning plates 541 and 542 reside when the finisher 500 is not operative. Moves of the front and rear aligning plates 541 and 542 to the home positions are controlled by signals from front and rear aligning plate home sensors S772 and S773 shown in FIG. 8 and described later.

In response to the conveyance of a sheet by the swing and guide portion 50, the front and rear aligning plates 541 and 542 move to predetermined standby positions set in advance corresponding to sizes of the sheet (longitudinal and widthwise lengths). The sheet bundle stacking portion 52 includes a stacking tray 504 configured to stack the sheets (sheet bundle) processed in the sheet processing portion 51.

Figure 4A:
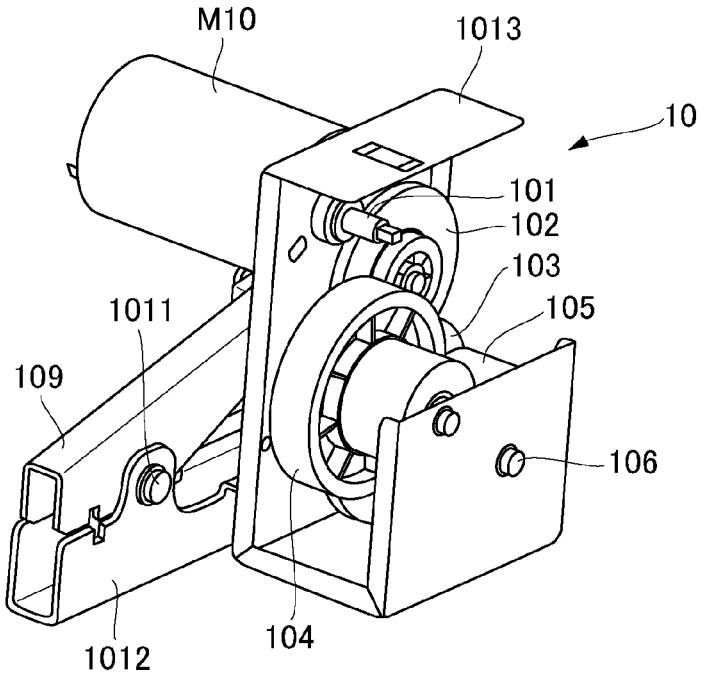
FIG. 4A is a perspective view illustrating a configuration of a staple-less binding unit provided in the finisher.

The staple-less binding unit 10 is a binding portion having lower and upper teeth 1014 and 1010 detailed later and binds the sheet bundle formed on the intermediate processing tray 540 by biting by the lower and upper teeth 1014 and 1010. Specifically, as shown in FIG. 4A, the staple-less binding unit 10 includes a clinch motor M10, a gear 101 rotated by the clinch motor M10, stage gears 102 through 104 rotated by the gear 101, and a gear 105 rotated by the stage gears 102 through 104. The staple-less binding unit 10 also includes a lower arm 1012 fixed to a frame 1013 and an upper arm 109 provided swingably with respect to the lower arm 1012 centering on a shaft 1011 and is biased to the lower arm side by a bias member not shown.

Figure 4B:
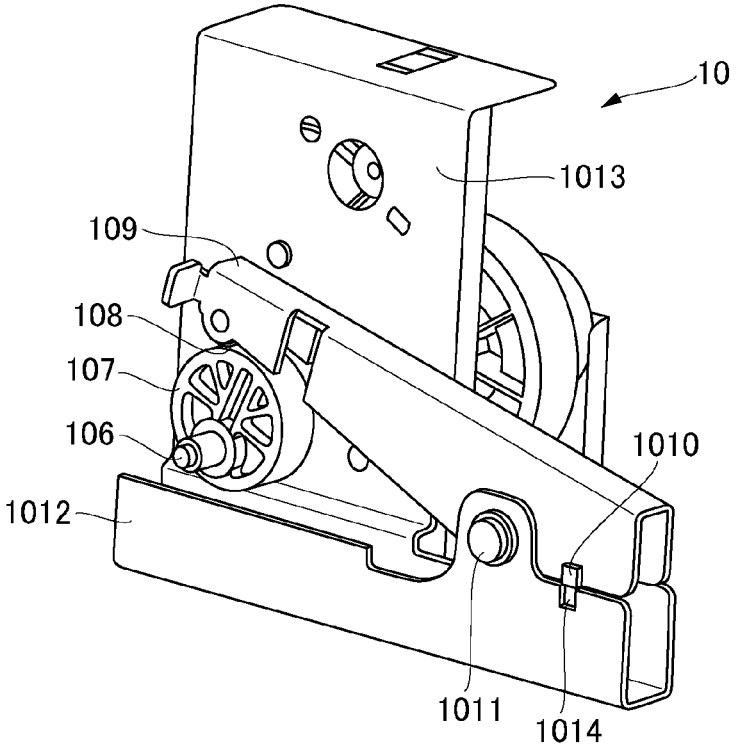
FIG. 4B is a perspective view illustrating a relationship between an upper arm and a cam of the staple-less binding unit.

Here, the gear 105 is mounted to a rotational shaft 106. Then, a cam 107 is mounted to the rotary shaft 106 as shown in FIG. 4B, and the cam 107 is provided between the upper and lower arms 109 and 1012. With this arrangement, when the clinch motor M10 rotates, the rotation of the clinch motor M10 is transmitted to the rotary shaft 106 through the gear 101, the stage gears 102 through 104, and the gear 105, and rotates the cam 107.

Figure 5A:
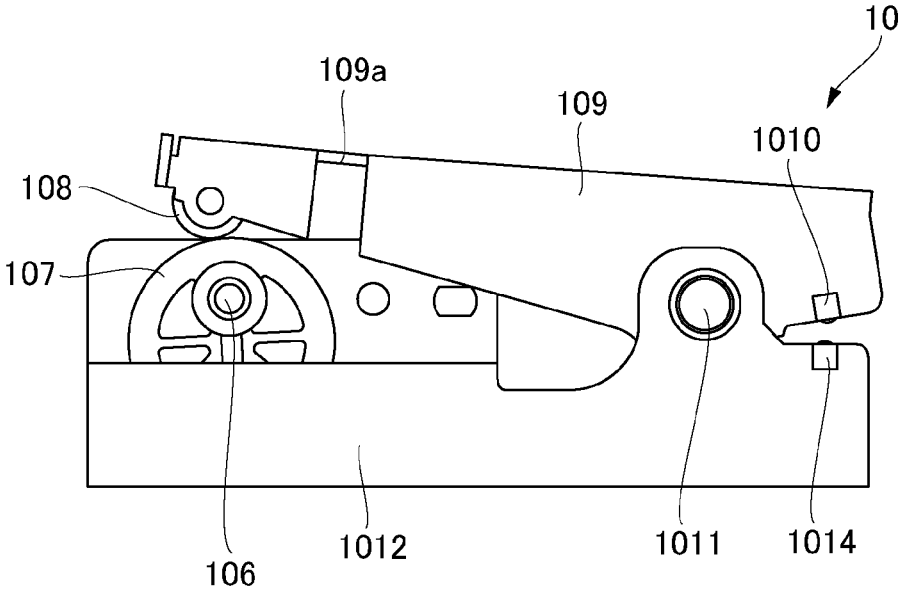
FIG. 5A illustrates the staple-less binding unit in a condition in which teeth of upper and lower dies are disengaged.
Figure 5B:
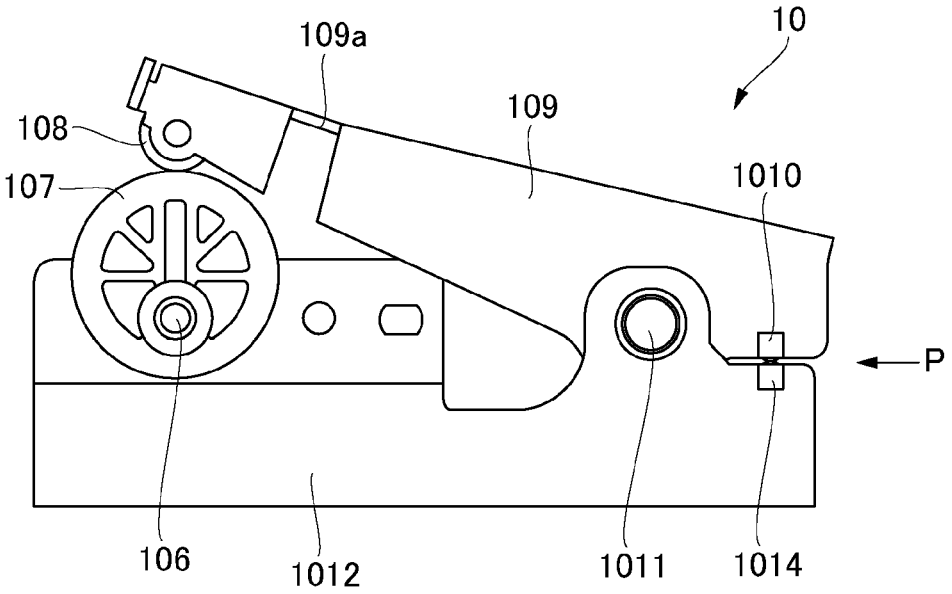
FIG. 5B illustrates the staple-less binding unit in a condition in which the teeth of the upper and lower dies are engaged.

When the cam 107 thus rotates, a cam-side end portion of the upper arm 109 in pressure contact with the cam 107 through an intermediary of a roller 108 as shown in FIG. 5A by being biased by a bias member not shown rises as shown in FIG. 5B. Here, the upper arm 109 is provided with upper teeth 1010 attached at a lower end of an end portion thereof on a side opposite from the cam 107, and the lower arm 1012 is provided with lower teeth 1014 disposed at an upper end of an end portion thereof on a side opposite from the cam 107.

With this arrangement, the end portion on the side opposite from the cam 107 of the upper arm 109 drops when the cam-side end portion of the upper arm 109 rises and along with that, the upper teeth 1010 drop and engage with the lower teeth 1014, pressing the sheets interposed between the upper and lower teeth. When the sheets are pressed as described above, fibers of surfaces of the sheets S are exposed as the sheets are stretched. By being pressed further, the fibers of the sheets are entangled with each other and are fastened. That is, the sheets are fastened in the binding process carried out on the sheets (sheet bundle) by biting (pressure-engaging) the sheets by the upper teeth 1010 of the upper arm 109 and the lower teeth 1014 of the lower arm 1012 by swinging the upper arm 109. It is noted that the binding process of binding a sheet bundle by biting the sheet bundle between the lower and upper teeth 1014 and 1010 of the binding unit 10 without using staples will be referred to as a 'staple-less binding process' in the explanation hereinafter.

Figure 6:
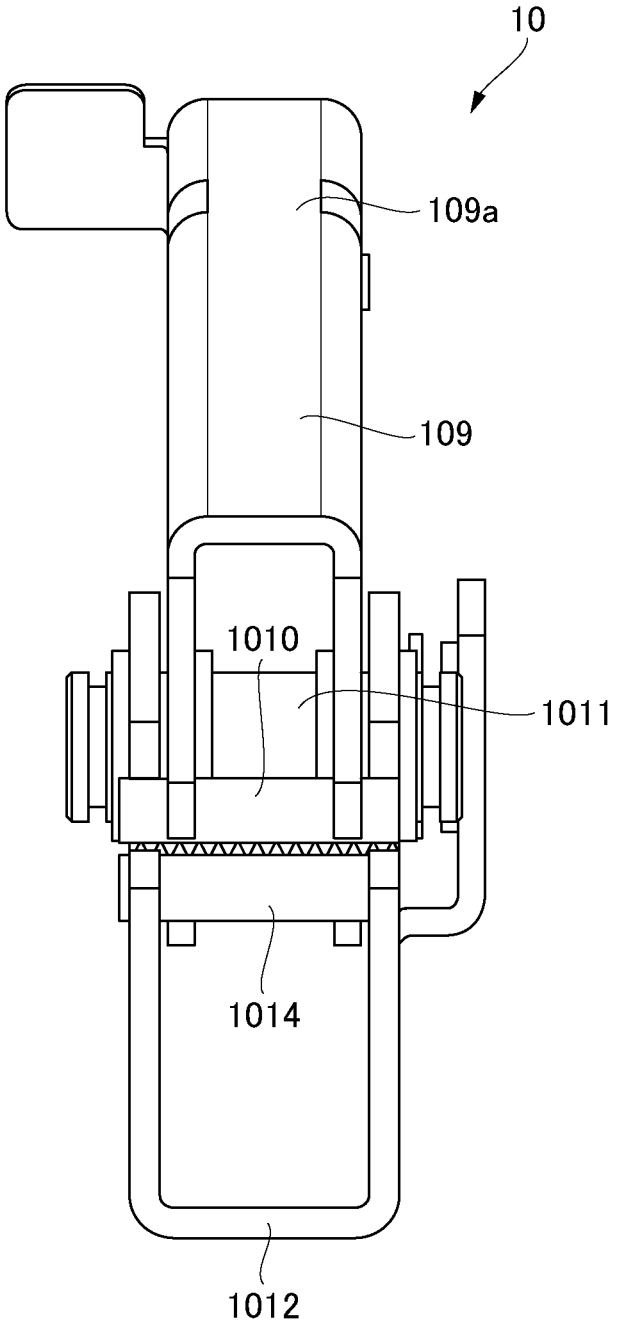
FIG. 6 is a side view of the staple-less binding unit seen from a direction of an arrow P shown in FIG. 5B.

FIG. 6 is a side view of the staple-less binding unit seen from a direction of an arrow P in FIG. 5B. The lower teeth 1014, i.e., a first die portion, have a plurality of valley teeth arrayed side by side, and the upper teeth 1010, i.e., a second die portion, facing the lower teeth 1014 have a plurality of ridge teeth arrayed side by side. That is, these lower and upper teeth 1014 and 1010 are disposed so as to face with each other and have the plurality of concave and convex teeth that engage with each other.

Figure 7:
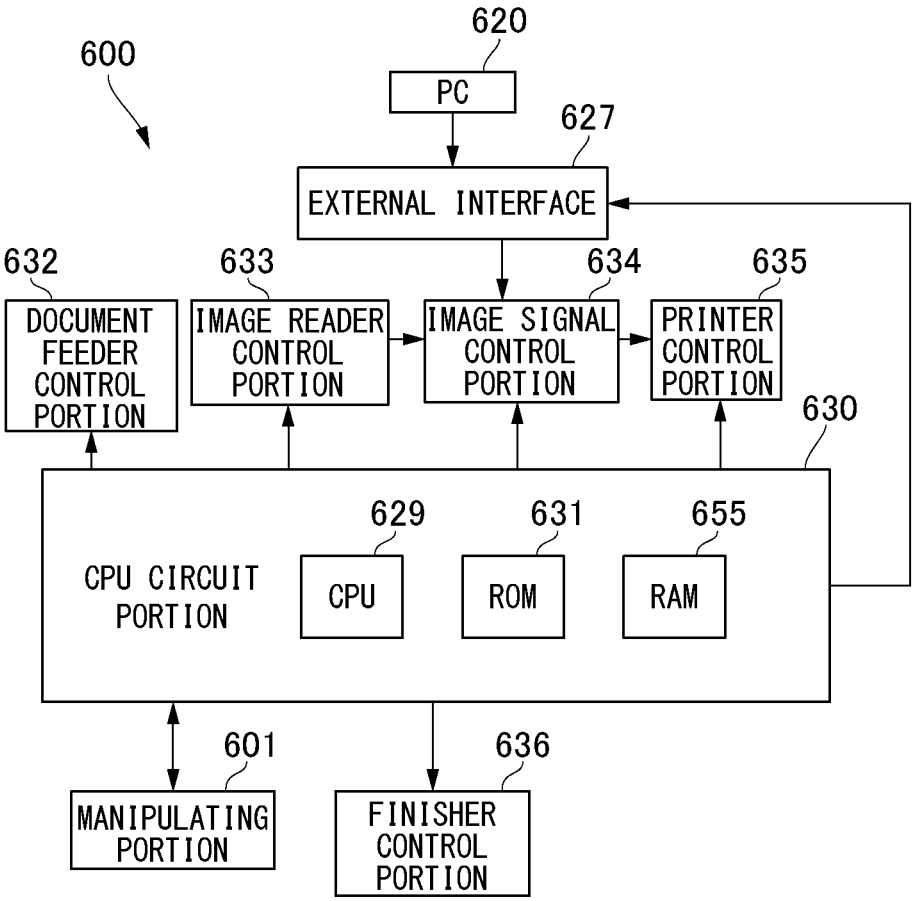
FIG. 7 is a control block diagram of the image forming apparatus.

FIG. 7 is a control block diagram of the image forming apparatus 1. As shown in FIG. 7, a control portion 600 includes a CPU circuit portion 630, a document feeder control portion 632, an image reader control portion 633, an image signal control portion 634, a printer control portion 635, a finisher control portion 636, and a manipulating portion 601, i.e., an input portion.

The CPU circuit portion 630 includes a CPU 629, a ROM 631, and a RAM 655. The CPU 629 controls the document feeder control portion 632, the image reader control portion 633, the image signal control portion 634, the printer control portion 635, and the finisher control portion 636 in accordance to programs stored in the ROM 631 and settings input from the manipulating portion 601. The RAM 655 is used as an area for temporarily holding control data and as a working area for calculations accompanying to the controls. It is noted that the RAM 655 also stores information on occurrence of jamming, errors and the like.

The document feeder control portion 632 controls the document feeding apparatus 121, and the image reader control portion 633 controls the scanner unit 124, the image sensor 129 and others that read information of a document fed from the document feeding apparatus 121 (see FIG. 1). Data of the document read by the image reader control portion 633 is output to the image signal control portion 634. The printer control portion 635 controls the apparatus body 200. An external interface 627 is an interface connecting an external computer 620 with the apparatus body 200, and develops print data input from the external computer (PC) 620 to image data and outputs it to the image signal control portion 634 for example. The image data output to the image signal control portion 634 is output to the printer control portion 635 to form an image in the image forming portion 201.

The finisher control portion 636 is mounted in the finisher 500, and controls the whole drive of the finisher 500 while exchanging information with the CPU circuit portion 630. As shown in FIG. 8, the finisher control portion 636 includes a CPU 701, a RAM 702, a ROM 703, a network interface 704, a communication interface 706, a conveyance control portion 707, an intermediate processing tray control portion 708, a staple-less binding control portion 709, and others. It is noted that it is also possible to arrange such that the control portion 600 controls the whole drive of the finisher 500 without using the finisher control portion 636.

Sensor signals from units and others connected with the CPU 701, the network interface 704 and the communication interface 706 are input to input ports of an input/output portion (I/O) 705 of the finisher control portion 636. Meanwhile, output ports of the input/output portion (I/O) 705 are connected with the conveyance control portion 707, the intermediate processing tray control portion 708 and the staple-less binding control portion 709. Then, the CPU 701 outputs predetermined signals from the output ports of the input/output portion (I/O) 705 to the respective driving systems of the conveyance control portion 707, the intermediate processing tray control portion 708 and the staple-less binding control portion 709.

The conveyance control portion 707 controls conveyance of a sheet to be conveyed to the finisher 500 by controlling the sheet position detecting sensor 5770 and the conveyance motor M750. The intermediate processing tray control portion 708 controls and drives the respective home sensors 5771, 5772 and 5773 and the respective motors M751, M752, M753, and M754. The intermediate processing tray control portion 708 controls the moves of the front and rear aligning plates 541 and 542, the drive of the return belt 560, the swinging motion of the swing arm 551, and the rotation of the swing roller 550 by thus controlling the respective home sensors and the respective motors. The staple-less binding control portion 709 controls the binding operation of the staple-less binding unit 10 by controlling a home sensor S10 detecting a position of the cam 107, and the clinch motor M10.

Figure 9A:
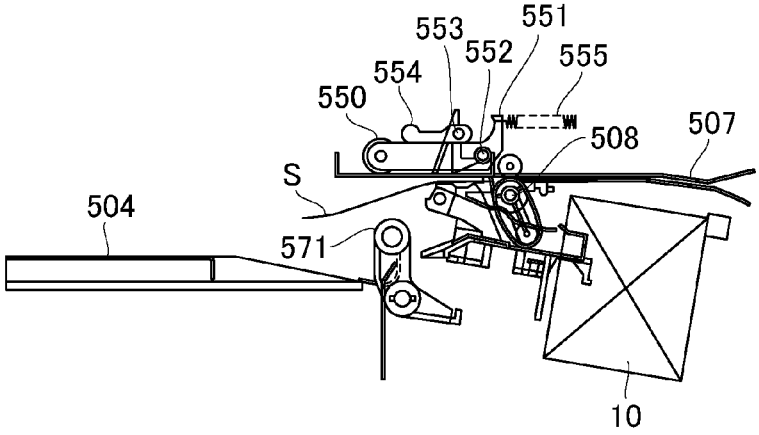
FIG. 9A illustrates the finisher in a condition in which a sheet is conveyed from an apparatus body.
Figure 9B:
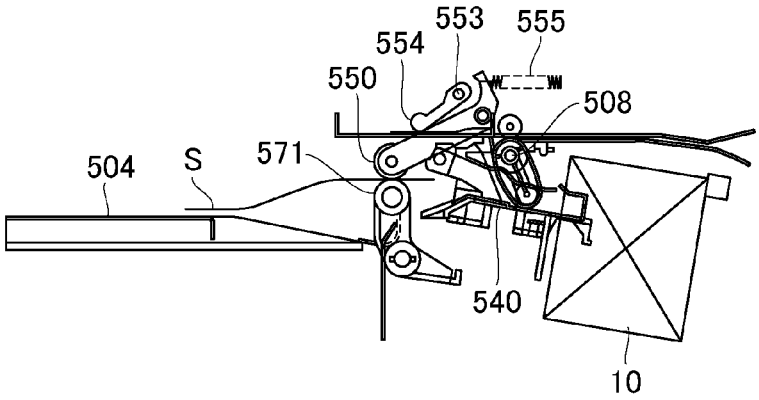
FIG. 9B illustrates the finisher in a condition in which a swing arm has dropped.

Next, a sheet processing operation carried out by the finisher 500 will be described. As shown in FIG. 9A, a sheet S discharged out of the apparatus body 200 is conveyed toward the stacking tray 504 by the discharge roller 508 provided along the conveying path 507. When the sheet S is discharged out of the discharge roller 508, the cam shaft 553 of the swing cam 554 is rotated by the swing arm driving motor M751, so that the swing cam 554 is rotated downward and presses the swing arm 551. Thereby, the swing arm 551 swings counterclockwise as shown in FIG. 9B centering on the swing shaft 552 by resisting against the tensile spring 555. Then, when the swing arm 551 swings counterclockwise, the swing roller 550 drops and thereby a rear end of the sheet drops by the swing roller 550 and is nipped between the swing roller 550 and a driven roller 571.

Figure 9C:
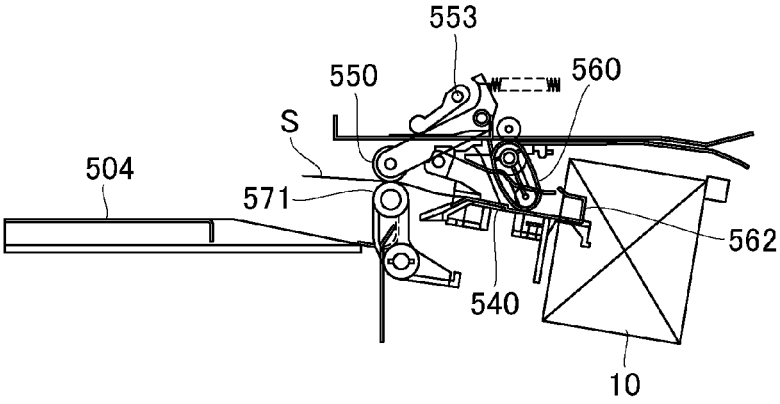
FIG. 9C illustrates the finisher in pulling the sheet that has been conveyed into an intermediate processing tray.

Next, the swing roller 550 rotates counterclockwise by being driven by the swing roller driving motor M752, so that the sheet S is pulled in upstream in the sheet conveying direction. After that, the swing roller 550 rotates until when the rear end (upstream end in the sheet conveying direction) of the sheet S comes in contact with the return belt 560 as shown in FIG. 9C. When the rear end of the sheet S comes into contact with the return belt 560, the return belt 560 rotates so as to pull in the sheet S. Thereby, the rear end of the sheet S abuts against the rear end stopper 562, so that the sheet S is aligned in the sheet conveying direction. It is noted that the swing arm 551 swings upward by the tensile spring 555 until when a next sheet is conveyed, so that the swing roller 550 rises again up to the home position to be ready to discharge the next sheet.

Figure 10A:
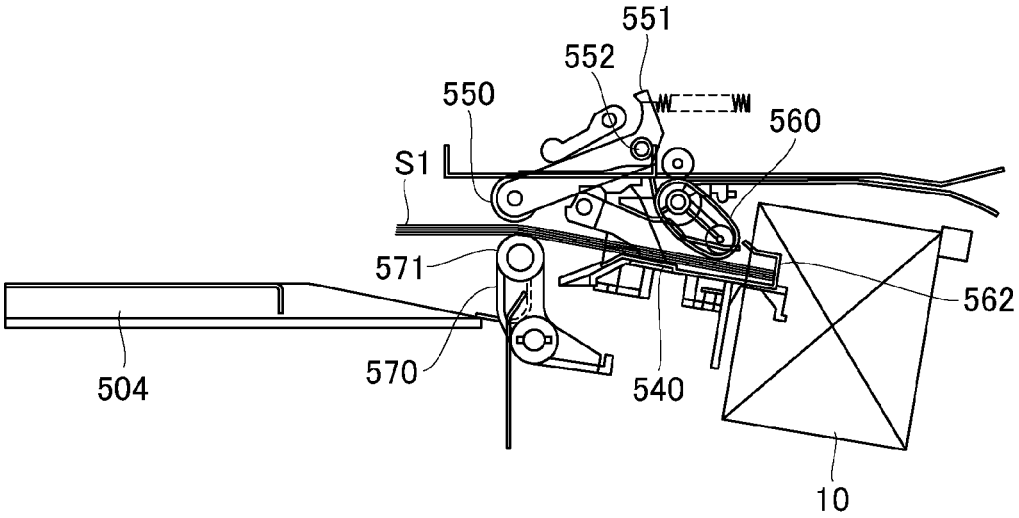
FIG. 10A illustrates the finisher in a condition in which a sheet bundle is formed on the intermediate processing tray.

Next, when the alignment of the sheet S in the sheet conveying direction on the intermediate processing tray 540 ends, the widthwise alignment of the sheet S is conducted by the front and rear aligning plates 541 and 542. After the alignment, a sheet bundle 51 is formed on the intermediate processing tray 540 as shown in FIG. 10A by carrying out such sheet conveying and aligning operations on succeeding sheets. FIG. 10A shows the sheet bundle S1 formed on the intermediate processing tray 540. When the sheet bundle S1 is formed, the swing arm 551 swings counterclockwise by being driven by the swing arm driving motor M751 so that the swing roller 550 drops. Then, the swing roller 550 forms a nip with the driven roller 571 and nips the sheet bundle S1. The staple-less binding unit 10 carries out the binding process on the rear end portion of the sheet bundle S1 in this condition.

Figure 8:
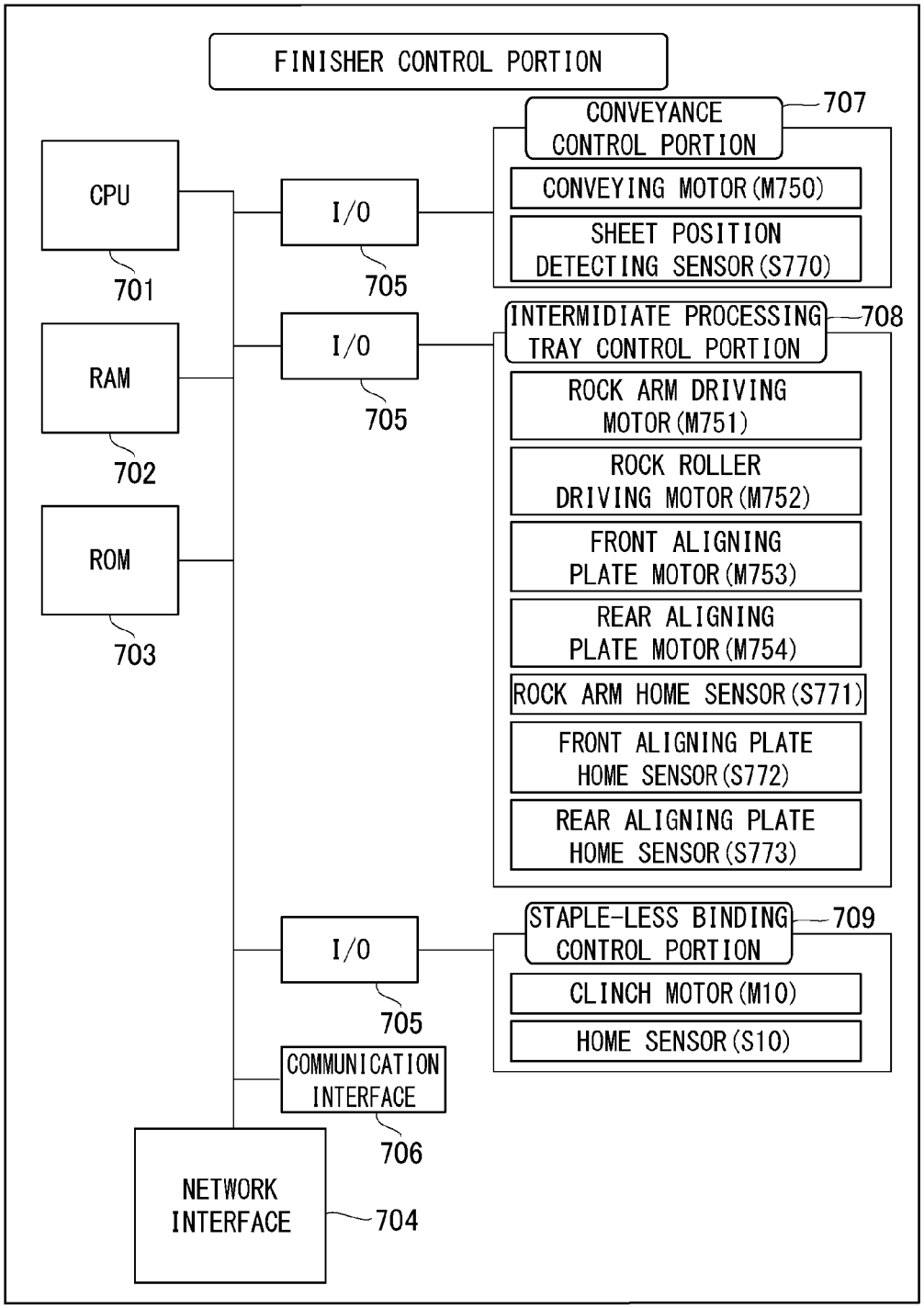
FIG. 8 is a block diagram of a finisher control portion configured to control the finisher.

When the staple-less binding unit 10 is to carry out the staple-less binding on the sheets, the staple-less binding unit 10 detects the cam position by the home sensor S10 shown in FIG. 8 and described above at first. It is noted that the rotation of the clinch motor M10 is controlled such that the cam 107 is located at a bottom dead point as shown In FIG. 5A described above in receiving a sheet before carrying out the staple-less binding. It is noted that when the cam 107 is thus located at the bottom dead point, a space that allows the sheets to enter is generated between the upper and lower teeth 1010 and 1014.

Then, when the sheet bundle is to be bound, the staple-less binding unit 10 rotates the clinch motor M10 to swing the upper arm 109 clockwise centering on the shaft 1011 by the cam 107. Then, when the cam 107 comes to a top dead point as shown in FIG. 5B, the upper teeth 1010 of the upper arm 109 engages with the lower teeth 1014 of the lower arm 1012 so that the sheets are fastened.

Figure 11:
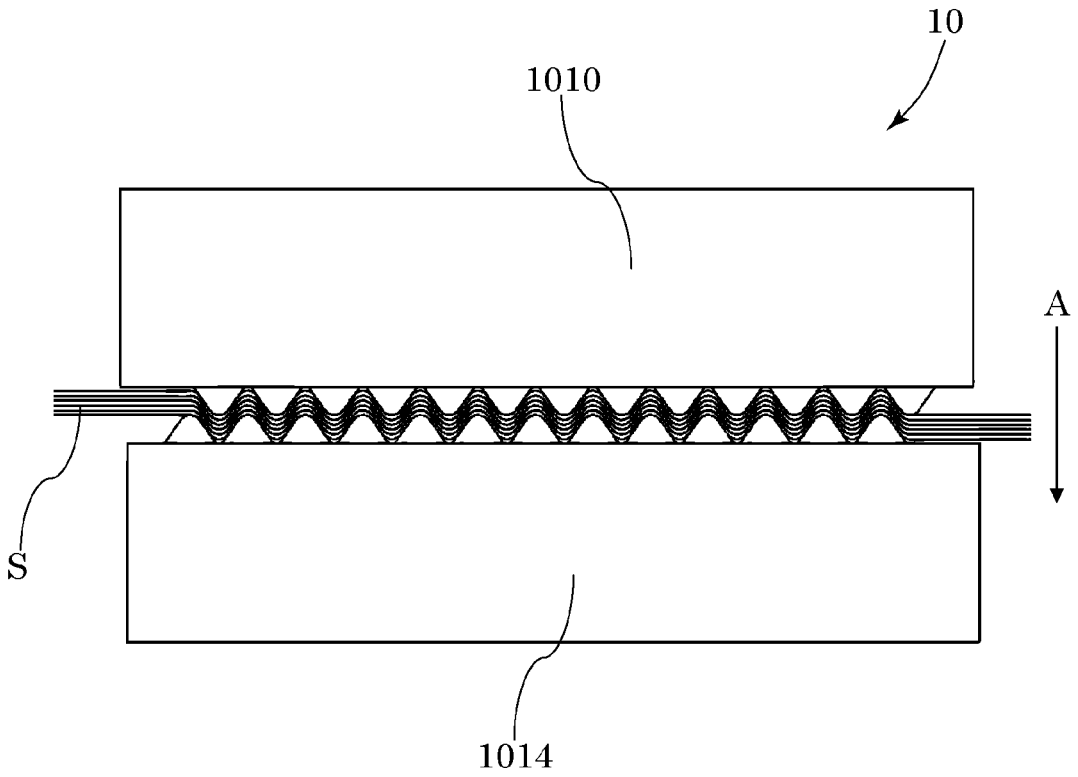
FIG. 11 is a section view illustrating a condition of the sheets bound without staple by the staple-less binding unit.

After that, when the cam 107 rotates further and arrives again at the bottom dead point, the home sensor S10 detects the cam 107 and the rotation of the clinch motor M10 is stopped. FIG. 11 is a diagram showing a condition in which a bundle of five sheets S is bound without staples by the staple-less binding unit 10. Here, the sheets S are fastened by entangling the fibers of the sheets by applying a load in a direction of an arrow A from the upper teeth 1010 to the fixed lower teeth 1014 in the present embodiment.

Figure 10B:
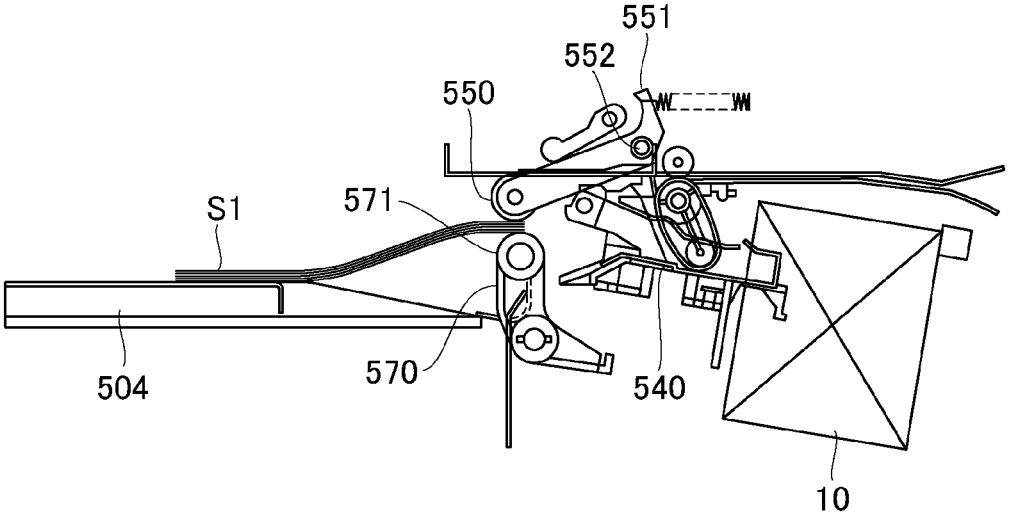
FIG. 10B illustrates the finisher in discharging the sheet bundle.

When the binding process on the sheet bundle S1 ends, the swing roller 550 rotates clockwise by being driven by the swing roller driving motor M752 in a condition in which the swing roller 550 nips the sheet bundle S1 with the driven roller 571 and discharges the sheet bundle S1 on the stacking tray 504 as shown in FIG. 10B. After that, the swing roller 550 separates from the sheet bundle S1 and returns to the home position.

By the way, there is a case when the image forming apparatus or the sheet processing apparatus halts or the staple-less binding unit causes an error during the staple-less binding operation carried out on the sheet bundle as described above by the reason of jamming or the like. If the sheet bundle is pulled out here to take out the sheet bundle on which the staple-less binding is being implemented, there is a case when the sheet is torn and paper powders attach on the teeth of the die portions. Still further, even if the staple-less binding process is carried out normally, there is a case when the die portions collect paper powders generated during the fastening process between teeth thereof if a number of times of the staple-less binding process increases. Then, if such paper powders attach on the teeth of the die portions or are collected between the teeth, the paper powders affect the engagement of the lower and upper die portions and drop a fastening power of a next sheet bundle on which a next staple-less binding process is carried out.

Then, in order to prevent the drop of the fastening power of the sheet bundle on which the staple-less binding process has been carried out, the control portion 600 (the finisher control portion 636) causes the staple-less binding unit 10 to carry out a cleaning process in which the upper teeth 1010 are engaged with the lower teeth 1014 in a non-binding process in which no binding process is carried out in the present embodiment.

More specifically, an idle striking operation is carried out by applying a load in the direction of the arrow (A) from the upper teeth 1010 to the lower teeth 1014 in a condition in which no sheet exists between the upper and lower teeth 1010 and 1014. That is, the idle striking operations or so-called idle striking of engaging the upper teeth 1010 with the lower teeth 1014 are carried out by moving the upper teeth 1010 in the condition in which no sheet exists in the present embodiment. Such idle striking operations make it possible to remove the paper dusts attached to engaging faces (inclined surfaces of the teeth) of the upper teeth 1010 or of the lower teeth 1014 out of the engaging faces.

Figure 12A:
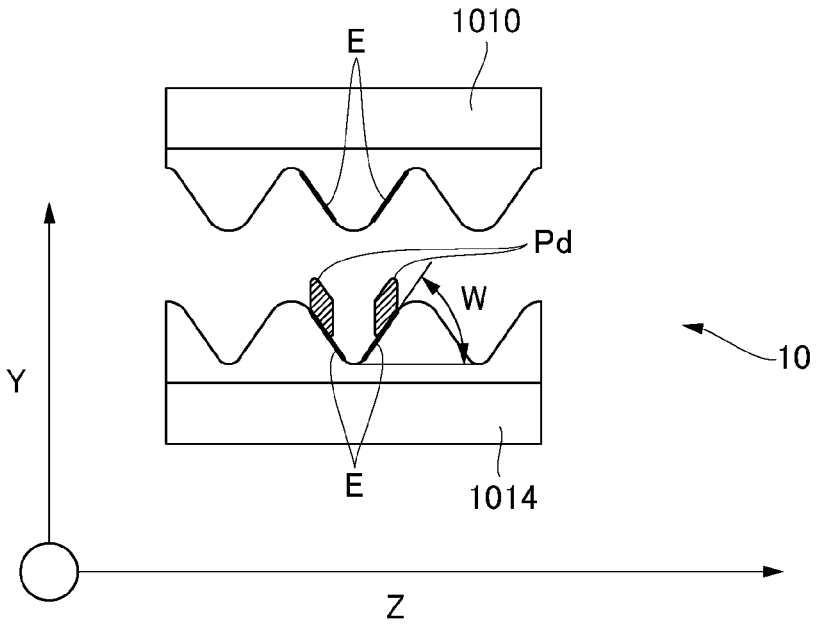
FIG. 12A illustrates the staple-less binding unit in a condition in which paper dusts are attached on lower teeth.
Figure 12B:
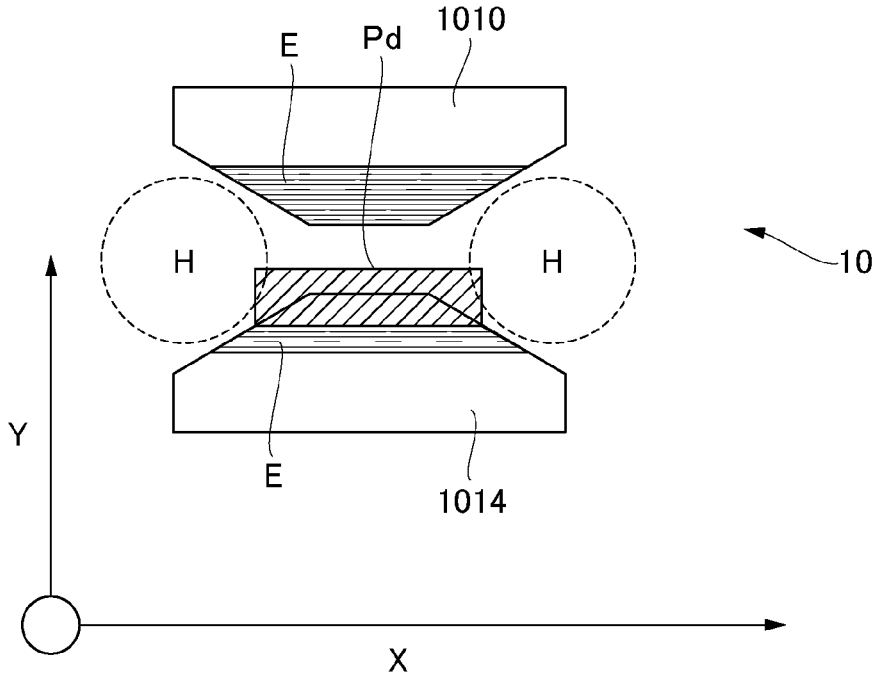
FIG. 12B is a side view of surfaces of the teeth shown in FIG. 12A.

Next, a principle for removing the paper dusts attached to the engaging faces of the upper teeth 1010 or the lower teeth 1014 out of the engaging faces will be explained. FIGS. 12A and 12B illustrate the condition in which the paper dusts Pd are attached to the engaging faces E of the lower teeth 1014 as a result of removal of a sheet bundle in a condition in which the upper and lower teeth 1010 and 1014 still bite into the sheet bundle due to jamming or an error. While the engaging faces E are parts of the inclined surfaces of the upper and lower teeth 1010 and 1014, FIG. 12A is a front view (Y-Z plane) of the tooth surfaces and FIG. 12B is a side view (X-Y plane) of the tooth surfaces. In FIG. 12B, H denotes a space formed in the width direction orthogonal to a direction in which the teeth are arrayed when the upper teeth 1010 engages with the lower teeth 1014.

Figure 13A:
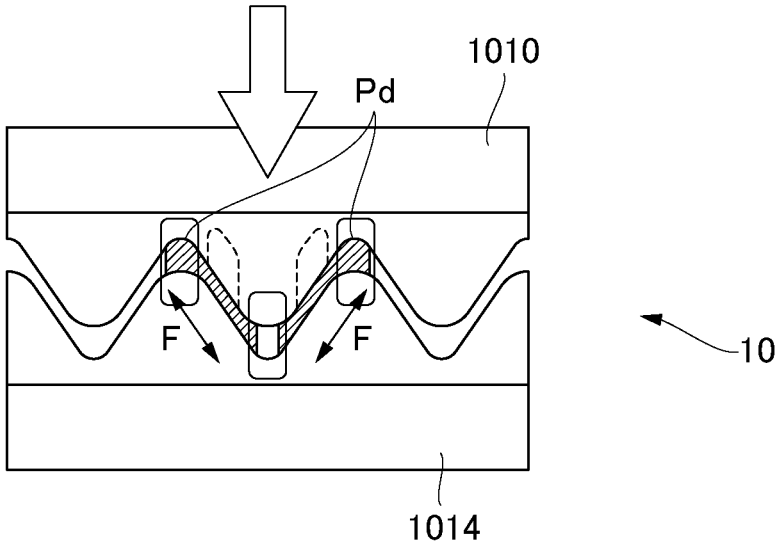
FIG. 13A illustrates a condition in which the lower teeth shown in FIG. 12A start to engage with upper teeth.

When the idle striking operation of the staple-less binding unit 10 is carried out, i.e., when the upper teeth 1010 is lowered, in the condition in which the paper dusts Pd thus attach to the engaging faces E of the lower teeth 1014, the paper dusts move along directions of the inclined surfaces of the teeth indicated by arrows F in FIG. 13A because each tooth of the lower teeth 1014 has a pressure angle W. It is noted that paper dusts not shown attached to the engaging faces of the upper teeth 1010 move in directions opposite from the arrows F.

Figure 13B:
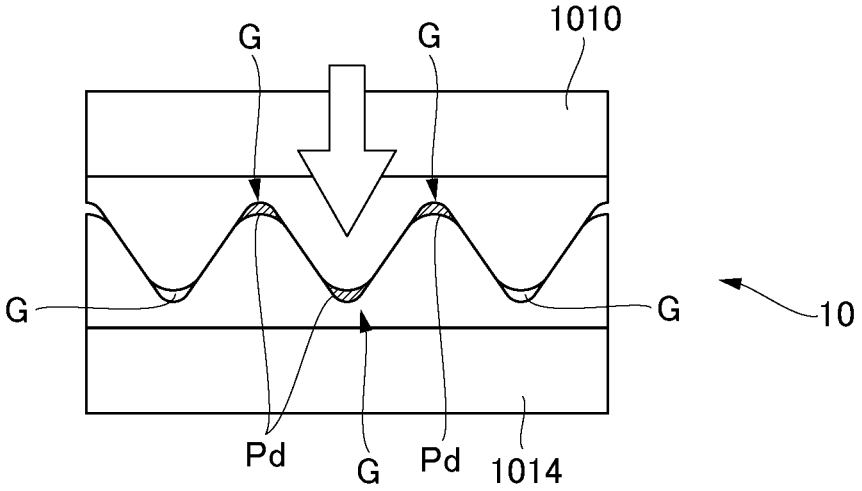
FIG. 13B illustrates a condition in which the lower teeth shown in FIG. 12A are engaged with the upper teeth.

Then, the paper dusts Pd moved to the inclined surface direction of the teeth move around to positions indicated by rectangular marks in the vicinity of tips and bottoms (troughs) of the teeth due to a pressure of the upper teeth 1010. When the upper teeth 1010 drops further, the paper dusts Pd are pushed out of gaps G formed respectively by the tips and bottoms of the teeth as shown in FIG. 13B and of the engaging faces by being pressed in the width direction in FIG. 12B, and are discharged to the spaces H shown in FIG. 12B.

Figure 14:
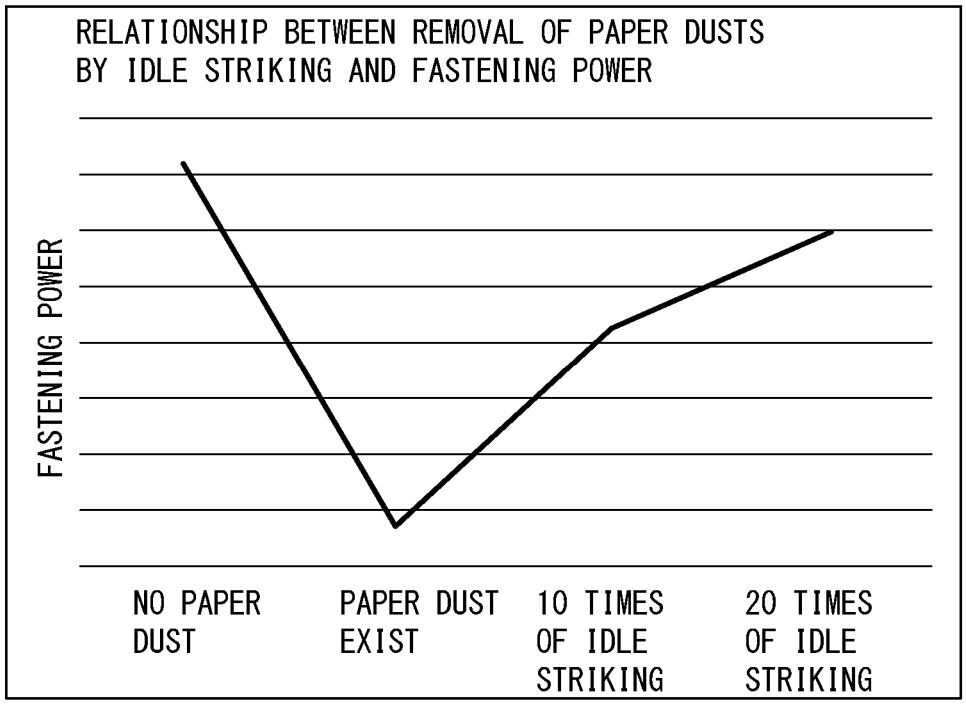
FIG. 14 is a graph showing a relationship between removal of paper dusts and a fastening power brought about by idle striking operations.

FIG. 14 is a graph showing a relationship between the removal of paper dusts and a fastening power brought about by the idle striking operations. The paper dusts remaining on the engaging faces are removed gradually to the outside of the engaging faces by repeating the idle striking operations by a plurality of times as described above, and the fastening power of the sheet bundle to be bound next by the staple-less binding process is restored. The paper dusts collected on the engaging faces of the lower teeth 1014 are all removed at last except those remaining in the gaps G as shown in FIG. 13B by repeating the idle striking operations by the plurality of times. It is then possible to carry out the staple-less binding process without damaging the fastening power by receiving a next sheet bundle in this condition. It is noted that although it is effective even if this idle striking operation is carried out once, it is possible to obtain a similar level of fastening power with a condition in which no paper dust exists by repeating the idle striking operation by 20 times or more for example as shown in FIG. 14. The control portion is set such that a number of times of the engagement between the upper and lower teeth 1010 and 1014 carried out in one cleaning process is greater than that carried out in one binding process in the present embodiment.

Figure 15:
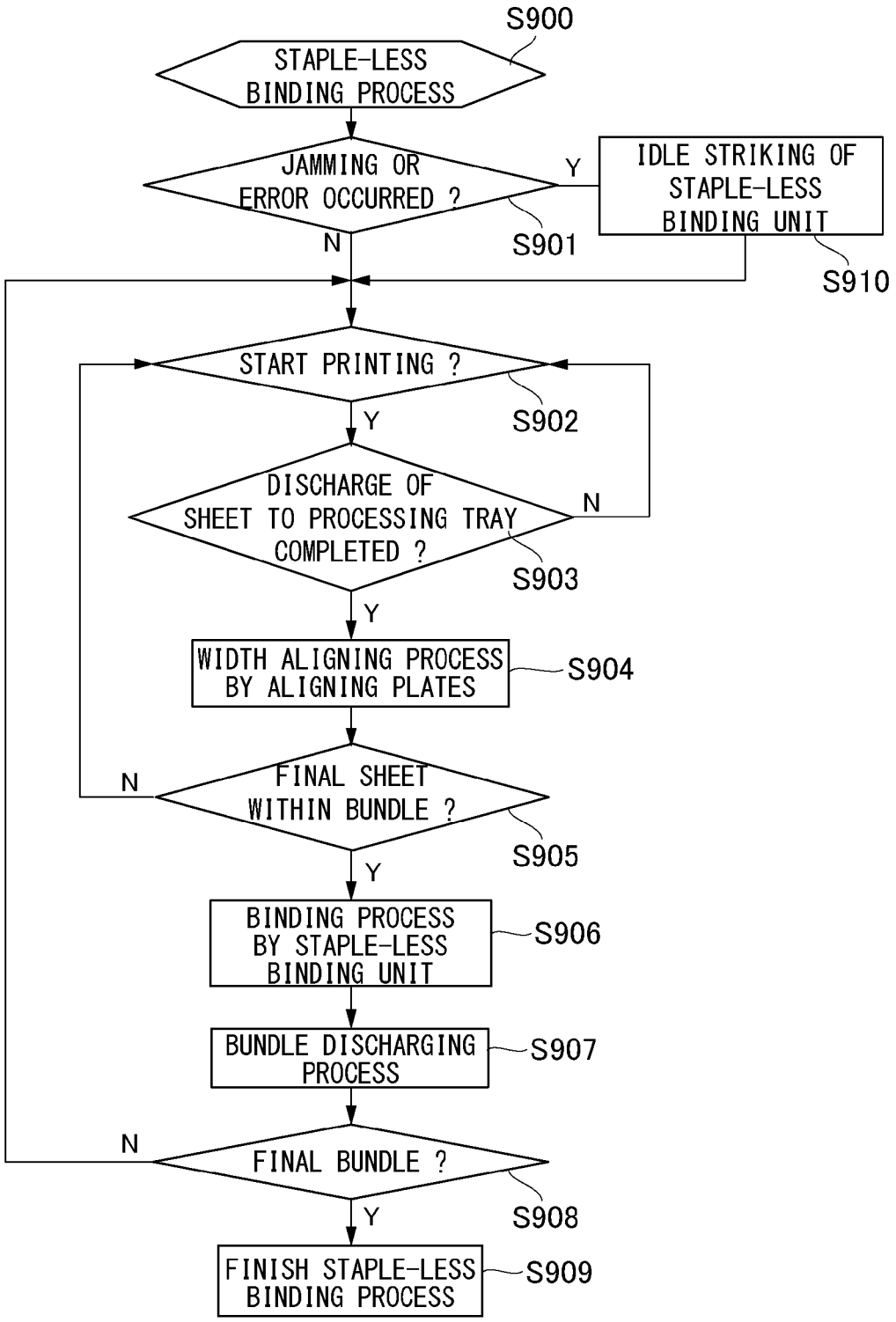
FIG. 15 is a flowchart showing a staple-less binding operation of the staple-less binding unit.

FIG. 15 is a flowchart showing the staple-less binding operation of the present embodiment. When the staple-less process is selected through the manipulating portion 601 in Step 900, the control portion 600 judges whether or not jamming or an error that halted the staple-less binding unit 10 has occurred during the previous binding operation from information stored in the RAM 655 in Step 901.

If no jamming or error has occurred during the previous binding operation, i.e., No in Step 901, the control portion 600 starts to print by the apparatus body 200 in Step 902. If an error has occurred during the previous binding operation, i.e., Yes in Step 901, the control portion 600 causes the staple-less binding unit 10 to carry out the idle striking by a plurality of times through the finisher control portion 636 before starting the staple-less binding process in Step 910. After that, the control portion 600 starts to print by the apparatus body 200 in Step 902.

Next, when the discharge of the sheets to the intermediate processing tray 540 of the finisher 500 is completed, i.e., Yes in Step 903, the finisher control portion 636 executes a width aligning process by the front and rear aligning plates 541 and 542 in Step 904. Then, when the width aligning process ends, the finisher control portion 636 judges whether or not the discharged sheet is a final sheet within a bundle in Step 905, and repeats the operations of Step 902 through S904 when the discharged sheet is not the final sheet within the bundle (No in Step 905).

When the discharged sheet is the final sheet within the bundle, i.e., Yes in Step 905, the finisher control portion 636 executes the binding process by the staple-less binding unit 10 in Step 906 and then executes a bundle discharge process of discharging the sheet bundle bound without staple in Step 907. Next, the finisher control portion 636 judges whether or not the discharged sheet bundle is a final bundle in Step 908, and repeats the operations of Steps 902 through 907 when the discharged sheet bundle is not the final bundle, i.e., No in Step 908. When the discharged sheet bundle is the final bundle, i.e., Yes in Step 908, the control portion 600 ends the staple-less binding process in Step 909.

As described above, the present embodiment is arranged such that the idle striking operation is carried out in the condition in which no sheet exists between the upper and lower teeth 1010 and 1014 before starting the staple-less binding process when an error has occurred during the previous binding process. Such an idle striking operation makes it possible to remove dusts of the sheet attaching to teeth of the upper and lower teeth 1010 and 1014 due to abnormal operations such as jamming and errors and to prevent a drop of fastening power in carrying out the staple-less binding process.

It is noted that although the case of providing the upper teeth 1010 so as to be movable in the up-and-down direction has been explained in the present embodiment, the present invention is not limited to that and at least one of the upper and lower teeth 1010 and 1014 may be made movable. Still further, the idle striking operation is carried out when an error has occurred in the previous binding operation in the explanation above, the invention is not limited also to that. That is, the idle striking operation may be carried out at predetermined timing that will not increase a total amount of time during which the sheets on which images have been formed is bound, as follows.

For instance, the idle striking operation may be carried out before starting the staple-less binding process (between image forming jobs or during standby time) regardless whether or not an error has occurred during the previous binding operation. In other words, it is possible to arrange such that the sheet bundle staple-less binding operation is started after carrying out the idle striking operation before when a sheet bundle on which a next staple-less binding process is to be carried out is stacked on the intermediate processing tray 540. Still further, it is possible to carry out the idle striking operation before starting the binding operation again when the staple-less binding unit 10 halts during a sheet binding operation regardless whether or not an error has occurred during the previous binding operation.

Still further, because dusts of sheets attach to the teeth of the upper and lower teeth 1010 and 1014 by also carrying out the normal staple-less binding, it is possible to arrange such the idle striking operation is carried out every time when a predetermined number of times of the binding operation is carried out. It is noted that this predetermined number of times is input to the finisher control portion 636 from the manipulating portion 601 or by the external computer (PC) 620 serving as another input portion. Then, the finisher control portion 636 controls the staple-less binding unit 10 to carry out the idle striking operation after executing the input number of times of binding operation. It is noted that the predetermined number of times may be changed corresponding to environment conditions because high moisture sheets are softened and paper powder tends to be collected between the teeth. In this case, an arrangement is made such that a moisture sensor not shown is provided for example and the finisher control portion 636 changes the predetermined number of times based on information from the moisture sensor.

Still further, although the upper and lower teeth 1010 and 1014 are engaged in the condition in which no sheet exists during the cleaning process in the embodiment described above, it is possible to engage the upper and lower teeth 1010 and 1014 in a condition in which a cleaning sheet that adsorbs paper powder and the like is interposed. Furthermore, although the finisher is provided integrally within the image forming apparatus in the embodiment described above, they may be configured separately.

INDUSTRIAL APPLICABILITY

The sheet processing apparatus of the invention can be used for the finisher for use in the image forming apparatus such as a printer, and is suitably used for the finisher that binds a sheet bundle without using staples.

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-242699, filed on Nov. 2, 2012, which is hereby incorporated by reference herein in its entirety.

The invention claimed is:

1. A sheet processing apparatus, comprising:

a sheet stacking portion on which sheets are stacked;

a binding portion having first and second die portions disposed so as to face each other and having a plurality of concave and convex teeth that engage with each other, the binding portion binding a sheet bundle on the sheet stacking portion by biting the sheet bundle by the first and second die portions; and a control portion configured to control the binding portion to carry out a binding process of binding the sheet bundle by biting the sheet bundle by the first and second die portions and to carry out a cleaning process of engaging the first and second die portions in a non-binding process in which no binding process is carried out.

2. The sheet processing apparatus according to claim 1, wherein the control portion executes the cleaning process by engaging the first and second die portions in a condition in which no sheet exists between the first and second die portions.

3. The sheet processing apparatus according to claim 2, wherein the first and second die portions are formed such that gaps are generated between tips of the teeth of the first die portion and bottoms of the teeth of the second die portion and between bottoms of the teeth of the first die portion and tips of the teeth of the second die portion in the condition in which the first and second die portions are engaged.

4. The sheet processing apparatus according to claim 3, wherein the control portion sets such that a number of times of the engagement between the first and second die portions carried out in one cleaning process is greater than that carried out in one binding process.

5. The sheet processing apparatus according to claim 4, wherein the control portion executes the cleaning process before executing a next binding process when it is judged that the binding portion has halted during a previous binding operation.

6. The sheet processing apparatus according to claim 5, wherein the control portion executes the cleaning process after executing the binding process by a predetermined number of times.

7. The sheet processing apparatus according to claim 1, wherein the first and second die portions are formed such that gaps are generated between tips of the teeth of the first die portion and bottoms of the teeth of the second die portion and between bottoms of the teeth of the first die portion and tips of the teeth of the second die portion in the condition in which the first and second die portions are engaged.

8. The sheet processing apparatus according to claim 1, wherein the control portion sets such that a number of times of the engagement between the first and second die portions carried out in one cleaning process is greater than that carried out in one binding process.

9. The sheet processing apparatus according to claim 1, wherein the control portion executes the cleaning process before executing a next binding process when it is judged that the binding portion has halted during a previous binding operation.

10. The sheet processing apparatus according to claim 1, wherein the control portion executes the cleaning process after executing the binding process by a predetermined number of times.

11. The sheet processing apparatus according to claim 10, wherein the control portion controls the binding portion so as to carry out the cleaning process after when the predetermined number of times of the binding process is carried out based on the number of times input through an input portion from which the predetermined number of times is input.

12. The sheet processing apparatus according to claim 10, wherein the control portion changes the predetermined number of times corresponding to environmental conditions.

13. A sheet processing apparatus, comprising:

a sheet stacking portion on which sheets are stacked;

a binding portion having first and second die portions disposed so as to face each other and having a plurality of concave and convex teeth that engage with each other, the binding portion binding a sheet bundle on the sheet stacking portion by biting the sheet bundle by the first and second die portions; and a control portion configured to control the binding portion to carry out a binding process of binding the sheet bundle by biting the sheet bundle by the first and second die portions and to carry out an engaging process of engaging the first and second die portions in a condition in which no sheet exists between the first and second die portions.

14. An image forming apparatus, comprising:

an image forming portion configured to form an image on a sheet; and the sheet processing apparatus according to claim 13, configured to carry out a binding process on the sheet on which the image has been formed by the image forming portion.

15. The sheet processing apparatus according to claim 13, wherein the first and second die portions are formed such that gaps are generated between tips of the teeth of the first die portion and bottoms of the teeth of the second die portion and between bottoms of the teeth of the first die portion and tips of the teeth of the second die portion in the condition in which the first and second die portions are engaged.

16. The sheet processing apparatus according to claim 13, wherein the control portion sets such that a number of times of the engagement between the first and second die portions carried out in one engaging process is greater than that carried out in one binding process.

17. The sheet processing apparatus according to claim 13, wherein the control portion executes the engaging process before executing a next binding process when it is judged that the binding portion has halted during a previous binding operation.

18. The sheet processing apparatus according to claim 13, wherein the control portion executes the engaging process after executing the binding process by a predetermined number of times.

19. The sheet processing apparatus according to claim 18, further comprising an input portion configured to input the predetermined number of times.

20. The sheet processing apparatus according to claim 13, wherein the control portion controls the binding portion such that the engagement between the first and second die portions is carried out multiple times in the engaging process.

21. An image forming apparatus, comprising:

an image forming portion configured to form an image on a sheet;

a sheet processing apparatus comprising a sheet stacking portion on which sheets are stacked, and a binding portion having first and second die portions disposed so as to face each other and having a plurality of concave and convex teeth that engage with each other, the binding portion binding a sheet bundle on the sheet stacking portion by biting the sheet bundle by the first and second die portions; and a control portion configured to control the sheet processing apparatus, wherein the control portion is configured to control the binding portion to carry out a binding process of binding the sheet bundle by biting the sheet bundle by the first and second die portions and to carry out an engaging process of engaging the first and second die portions in a condition in which no sheet exists between the first and second die portions.

* * * * *